US009829166B2

(12) United States Patent
Shibata et al.

(10) Patent No.: US 9,829,166 B2
(45) Date of Patent: Nov. 28, 2017

(54) VEHICULAR LAMP

(71) Applicant: Koito Manufacturing Co., Ltd., Tokyo (JP)

(72) Inventors: Yuichi Shibata, Shizuoka (JP); Hiroyuki Ishida, Shizuoka (JP); Takeshi Masuda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 10 days.

(21) Appl. No.: 15/013,841

(22) Filed: Feb. 2, 2016

(65) Prior Publication Data

US 2016/0153633 A1 Jun. 2, 2016

Related U.S. Application Data

(63) Continuation of application No. PCT/JP2014/003754, filed on Jul. 16, 2014.

(30) Foreign Application Priority Data

Aug. 9, 2013 (JP) ..... 2013-165806

(51) Int. Cl.
*F21V 11/00* (2015.01)
*F21V 9/00* (2015.01)
(Continued)

(52) U.S. Cl.
CPC ..... *F21S 48/1145* (2013.01); *F21S 48/1323* (2013.01); *F21S 48/1388* (2013.01);
(Continued)

(58) Field of Classification Search
USPC ..... 362/510, 509
See application file for complete search history.

(56) References Cited

U.S. PATENT DOCUMENTS

2011/0121732 A1* 5/2011 Tsutsumi ..... F21S 48/1159 315/77
2014/0029285 A1* 1/2014 Bittinger ..... F21K 9/10 362/511

FOREIGN PATENT DOCUMENTS

CN 1464568 A 12/2003
CN 1682381 A 10/2005
(Continued)

OTHER PUBLICATIONS

English language machine translation of JP2012169375 to Sharp Corporation, Sep. 6, 2012.*
(Continued)

*Primary Examiner* — Daniel Hess
(74) *Attorney, Agent, or Firm* — Claire Zopf

(57) ABSTRACT

Vehicular lamp furnished with: a first light source emitting blue laser light having a peak wavelength in a wavelength region of 450 nm to 470 nm; a second light source emitting green laser light having a peak wavelength in a wavelength region of 510 nm to 550 nm; a third light source emitting red laser light having a peak wavelength in a wavelength region of 630 nm to 650 nm; a phosphor that by being excited by a portion of the blue laser light emitted by the first light source or of the green laser light emitted by the second light source emits excitation light having a peak wavelength in a wavelength region of 580 nm to 600 nm; and a light condensing unit for collecting the blue, green, and red laser light, and the excitation light, to generate white light.

4 Claims, 7 Drawing Sheets

(51) Int. Cl.

| | |
|---|---|
| ***F21S 8/10*** | (2006.01) |
| *F21Y 115/30* | (2016.01) |
| *F21Y 113/13* | (2016.01) |

(52) U.S. Cl.
CPC ..... *F21S 48/1757* (2013.01); *F21Y 2113/13* (2016.08); *F21Y 2115/30* (2016.08)

(56) References Cited

FOREIGN PATENT DOCUMENTS

| | | | |
|---|---|---|---|
| DE | 3916875 | A1 | 12/1990 |
| JP | 2003-095012 | A | 4/2003 |
| JP | 2004-241348 | A | 8/2004 |
| JP | 2010-036835 | A | 2/2010 |
| JP | 2012-169375 | A | 9/2012 |
| JP | 2012-221634 | A | 11/2012 |
| JP | 2013-125693 | A | 6/2013 |
| WO | 2013-088673 | A1 | 6/2013 |

OTHER PUBLICATIONS

International Search Report from International Application No. PCT/JP2014/003754, dated Sep. 2, 2014.
International Preliminary Report on Patentability from International Application No. PCT/JP2014/003754, date of issuance Feb. 9, 2016, dated Feb. 18, 2016.
Extended European Search Report from European Patent Application No. 14834957.4, dated Dec. 12, 2016.
SIPOaction on patentability in counterpart Chinese App. No. 201480041917.4, dated Mar. 14, 2017.

* cited by examiner

100

100

VEHICULAR LAMP

CROSS-REFERENCE TO RELATED APPLICATIONS

This application is based upon and claims the benefit of priority from the prior Japanese Patent Application No. 2013-165806, filed on Aug. 9, 2013 and International Patent Application No. PCT/JP2014/003754, filed on Jul. 16, 2014, the entire content of each of which is incorporated herein by reference.

BACKGROUND OF THE INVENTION

1. Field of the Invention

The present invention relates to vehicular lamps, and more particularly to vehicular lamps used in vehicles such as automobiles.

2. Description of the Related Art

A vehicular lamp furnished with a semiconductor light source, a mirror for reflecting around the vehicle light emitted from the semiconductor light source, and a scanning actuator for reciprocatingly swinging the mirror is disclosed in Patent Document 1. In this vehicular lamp, by the scanning actuator driving the mirror at high speed to sweep light reflected by the mirror over a predetermined illumination range around the vehicle, a predetermined light distribution pattern is formed forward of the vehicle (hereinafter, such an optical system will be referred to as a "scanning optical system"). Also, with these vehicular lamps, a red LED, a green LED and a blue LED are combined and used as the light source.

Patent Document 1: Japanese Unexamined Patent Application Publication No. 2010-36835.

Laser light sources are capable of emitting light of superior directivity and convergence by comparison with LEDs. Therefore, more so than with LEDs, laser light sources can serve to improve light utilization factor in the vehicular lamps. Since the light utilization factor of a vehicular lamp can be improved, laser light can be optimally employed in vehicular lamps equipped with an above-described scanning optical system, in which the light utilization factor is liable to degrade. Therein, as a cumulative result of concentrated research into vehicular lamps utilizing a laser light source, the present inventors found out that if the LED is replaced with a laser light source in an above-described conventional vehicular lamp, that is, if the white light is formed by combining red, green and blue laser light, there will be a sought-after improvement in the color rendering properties.

SUMMARY OF THE INVENTION

An object of the present invention, brought about taking such circumstances into consideration, is to afford technology that serves to improve color rendering properties of a vehicular lamp furnished with laser light sources.

The present invention in one embodiment relates to a vehicular lamp for resolving the above-described problems. The vehicular lamp comprises: a first light source that emits blue laser light having a peak wavelength in a wavelength region of from 450 nm to 470 nm (both inclusive); a second light source that emits green laser light having a peak wavelength in a wavelength region of from 510 nm to 550 nm (both inclusive); a third light source that emits red laser light having a peak wavelength in a wavelength region of from 630 nm to 650 nm (both inclusive); a phosphor that by being excited by either the blue laser light or the green laser light emits excitation light having a peak wavelength in a wavelength region of from 580 nm to 600 nm (both inclusive); and a light condensing unit for collecting the blue laser light, the green laser light, the red laser light, and the excitation light to generate white light.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
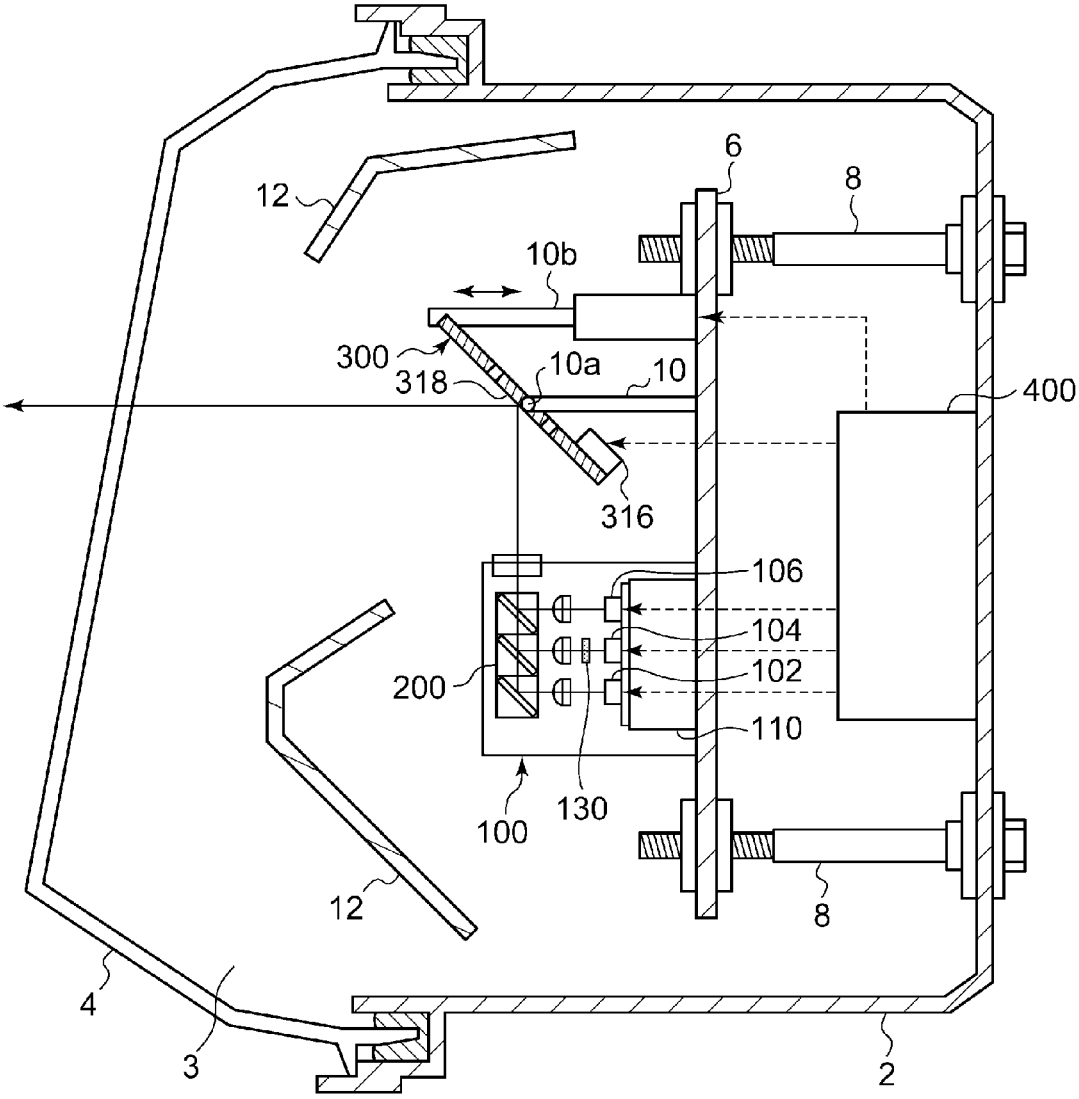
FIG. 1 is a vertical cross-sectional view schematically showing a structure of an automotive lamp according to a first embodiment.

The present invention in one embodiment relates to a vehicular lamp for resolving the above-described problems. The vehicular lamp comprises: a first light source that emits blue laser light having a peak wavelength in a wavelength region of from 450 nm to 470 nm (both inclusive); a second light source that emits green laser light having a peak wavelength in a wavelength region of from 510 nm to 550 nm (both inclusive); a third light source that emits red laser light having a peak wavelength in a wavelength region of from 630 nm to 650 nm (both inclusive); a phosphor that by being excited by either the blue laser light or the green laser light emits excitation light having a peak wavelength in a wavelength region of from 580 nm to 600 nm (both inclusive); and a light condensing unit for collecting the blue laser light, the green laser light, the red laser light, and the excitation light to generate white light. This embodiment enables improvement in the color rendering properties of a vehicular lamp provided with laser light sources.

A vehicular lamp in accordance with this embodiment may further comprise: a phosphor that by being excited by the blue laser light emits excitation light having a peak wavelength in a wavelength region of from 470 nm to 520 nm (both inclusive). A vehicular lamp in any of the foregoing embodying modes may further comprise: a phosphor that by being excited by the red laser light emits excitation light having a peak wavelength in a wavelength region of from 650 nm to 700 nm (both inclusive). These embodying modes enable further improvement in the color rendering properties of a vehicular lamp. It will be appreciated that combinations at will of the foregoing constituent elements, as well as substitutions for the constituent elements and expressions of the present invention made mutually among methods, apparatuses, systems, etc. may also be effective as modes of the present invention.

Hereinafter, the present invention will be described based on preferred embodiments with reference to the accompanying drawings. The same or equivalent constituents, members, or processes illustrated in each drawing will be denoted with the same reference numerals, and the repeated description thereof will be omitted as appropriate. The preferred embodiments do not intend to limit the scope of the invention but exemplify the invention. Not all of the features and the combinations thereof described in the embodiments are necessarily essential to the invention.

First Embodiment

FIG. 1 is a vertical cross-sectional view schematically showing a structure of an automotive lamp according to a first embodiment. In FIG. 1, a light source unit 100 is shown in a state where the interior thereof is seen through. Also, permanent magnets 312 and 314 of a scanning unit 300 are omitted in FIG. 1. An automotive lamp 1 according to the present embodiment is, for instance, an automotive headlamp apparatus that has a pair of headlamp units placed in left- and right-side front parts of a vehicle. Since the pair of headlamp units are of practically identical structure to each other, FIG. 1 shows the structure of either one of the left and right headlamp units, as an automotive lamp 1. The structure of the automotive lamp 1 described below is exemplary and is not limited to the structure shown and explained below.

The automotive lamp 1 includes a lamp body 2, having an opening on a frontward side of a vehicle, and a transparent cover 4, which covers the opening of the lamp body 2. The transparent cover 4 is formed of resin or glass, having translucency, for instance. A lamp chamber 3, which is formed by the lamp body 2 and the transparent cover 4, contains a supporting plate 6, a light source unit 100, a scanning unit 300, and a control unit 400.

The light source unit 100 and the scanning unit 300 are supported by the supporting plate 6 at predetermined positions in the lamp chamber 3. The supporting plate 6 is connected to the lamp body 2 by aiming screws 8 at corners of the supporting plate 6. The light source unit 100 has a first light source 102, a second light source 104, a third light source 106, a heatsink 110, a phosphor 130, a light condensing unit 200, and so forth. The light source unit 100 is fixed on a front surface of the supporting plate 6 such that the heatsink 110 is in contact with the supporting plate 6. A detailed description will be given later of the internal structure of the light source unit 100.

The scanning unit 300 has a reflector 318. The structure of the scanning unit 300 will be discussed later in detail. The scanning unit 300 is positioned relative to the light source unit 100 in a predetermined manner such that laser light emitted from the light source unit 100 is reflected in a frontward direction of the lamp. And the scanning unit 300 is secured to a protrusion 10 that protrudes on a frontward side of the lamp from the front surface of the supporting plate 6. The protrusion 10 has a pivot mechanism 10*a*, and the scanning unit 300 is supported by the protrusion 10 via the pivot mechanism 10*a*. Also, the protrusion 10 has a rod and a supporting actuator 10*b*, having a motor by which to elongate and contract this rod in the longitudinal directions of the lamp. The tip of the rod is connected to the scanning unit 300. The protrusion 10 enables the scanning unit 300 to make a swing motion by having the rod elongate and contract with the pivot mechanism 10*a* functioning as a shaft. This can adjust the inclination angle (pitch angle) of the scanning unit 300 in the vertical direction (initial aiming adjustment and the like). The supporting actuator 10*b* is connected to the control unit 400.

The control unit 400 includes a lamp ECU, a ROM, a RAM and so forth. The lamp ECU appropriately and selectively executes a control program and generates various control signals. The ROM stores various control programs. The RAM is used for data storage and used as a work area for the programs executed by the lamp ECU. The control unit 400 controls the drive of the supporting actuator 10*b*, the drive of a scanning actuator described later, the turning on and off of the first light source 102 to the third light source 106, and so forth. The control unit 400 is secured to the lamp body 2 such that the control unit 400 is located behind the supporting plate 6 toward the rear end of the lamp. The position where the control unit 400 is provided is not particular limited to this position.

The automotive lamp 1 is configured such that the light axis of the automotive lamp 1 is adjustable in the horizontal and vertical directions. More specifically, adjusting the position (posture) of the supporting plate 6 by rotating the aiming screws 8 allows the light axis thereof to be adjusted in the horizontal and vertical directions. An extension member 12, having an opening that allows the light reflected by the scanning unit 300 to travel toward a front area of the lamp, is provided in a frontward side of the light source unit 100 and the scanning unit 300 in the lamp chamber 3.

A detailed description is given hereunder of the structures of the light source unit 100 and the scanning unit 300 that constitute the automotive lamp 1.

Light Source Unit

Figure 2:
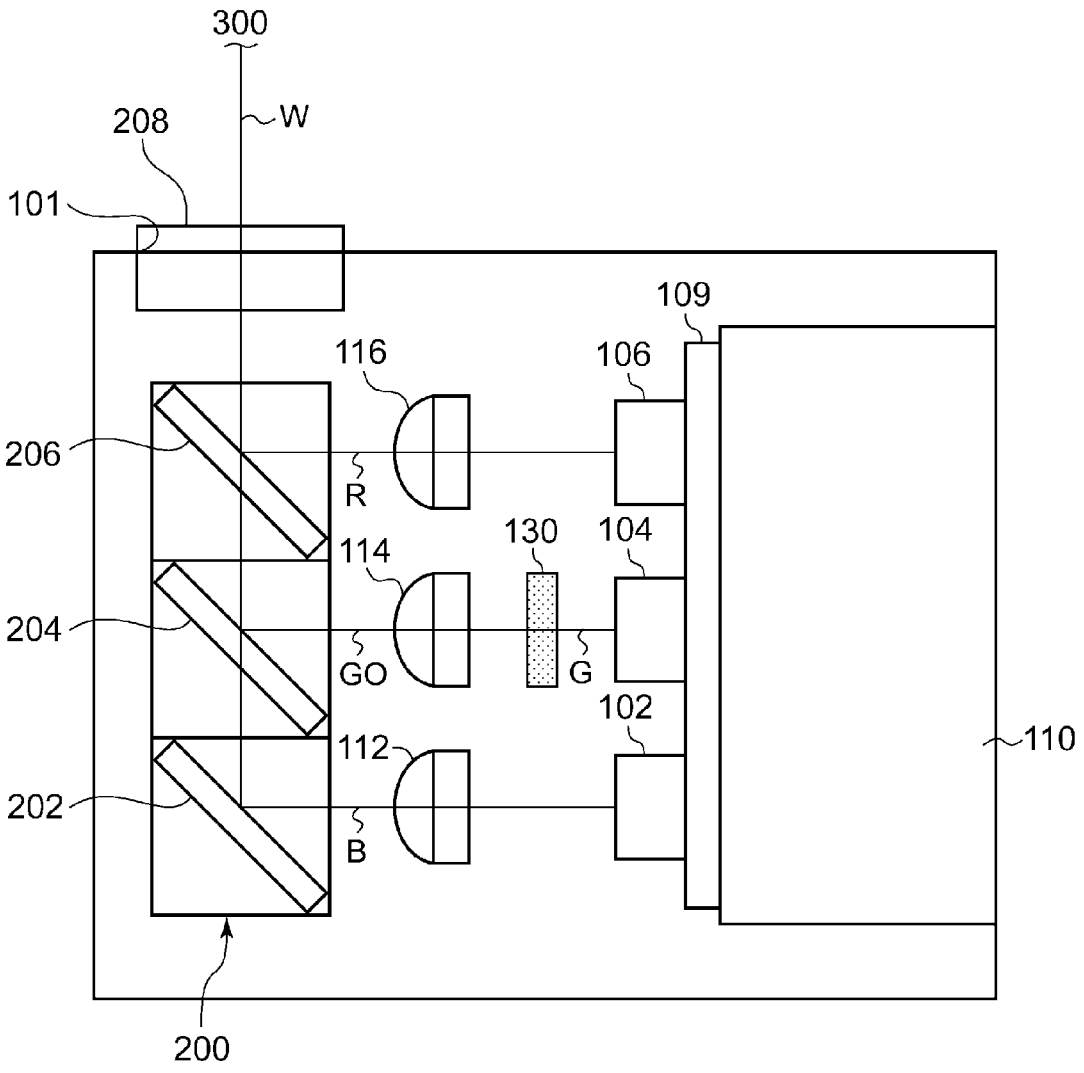
FIG. 2 is a side view schematically showing a structure of the light source unit.

FIG. 2 is a side view schematically showing a structure of the light source unit. Note that FIG. 2 is a transparent view showing the interior of the light source unit 100. The light source unit 100 has a first light source 102, a second light source 104, a third light source 106, a heatsink 110, a first lens 112, a second lens 114, a third lens 116, a phosphor 130, and a light condensing unit 200, and other components.

The first light source 102 emits a blue laser light B having a peak wavelength in a wavelength region of 450 nm to 470 nm (both inclusive). The second light source 104 emits a green laser light G having a peak wavelength in a wavelength region of 510 nm to 550 nm (both inclusive). The third light source 106 emits a red laser light R having a peak wavelength in a wavelength region of 630 nm to 650 nm (both inclusive). The first light source 102 to the third light source 106 are each constituted by a laser diode, for instance, and are mounted on a common substrate 109. Each light source may be constituted by a laser device other than the laser diode (e.g., solid-state laser, gas laser, etc.).

The first light source 102, the second light source 104 and the third light source 106 are arranged such that their respective laser light emission surfaces face a front area of the lamp and such that the substrate 109 faces a rear area of the lamp. Also, the first to third light sources 102, 104 and 106 are mounted on a surface of the heatsink 110 that faces a front area of the lamp. The heatsink 110 is formed of a material, having a high thermal conductivity, such as aluminum, for the purpose of efficiently recovering the heat produced by each light source. A rear-side surface of the heatsink 110 is in contact with the supporting plate 6 (see FIG. 1). The heat produced by each light source is radiated through the substrate 109, the heatsink 110 and the supporting plate 6.

The phosphor 130 is excited by the green laser light G and emits excitation light O having a peak wavelength in a wavelength region of 580 nm to 600 nm (both inclusive). The phosphor 130 converts the green laser light G into a substantially orange light by wavelength conversion. The structure of the phosphor 130 is publicly known so that a detailed description will be omitted. In this embodiment, a portion of the green laser light G emitted by the second light source 104 is used to excite the phosphor 130. The phosphor 130 is provided on the light path of the green laser light G. The green laser light G emitted from the second light source 104 is incident on the phosphor 130. A portion of the incident green laser light G is converted by the phosphor 130 into the excitation light O by wavelength conversion and is emitted therefrom. The remaining portion of the green laser light G is emitted from the phosphor 130 without being subjected to wavelength conversion. Therefore, a mixed light GO in which the green laser light G and the excitation light O are mixed is emitted from the phosphor 130.

The first lens 112, the second lens 114 and the third lens 116 are each a collimator lens, for instance. The first lens 112 is provided on a light path of the blue laser light B between the first light source 102 and the light condensing unit 200, and converts the blue laser light B, emitted from the first light source 102 toward the light condensing unit 200, into parallel light. The second lens 114 is provided on a light path of the mixed light GO between the phosphor 130 and the light condensing unit 200, and converts the mixed light GO, emitted from the phosphor 130 toward the light condensing unit 200, into parallel light. The third lens 116 is provided on a light path of the red laser light R between the third light source 106 and the light condensing unit 200, and converts the red laser light R, emitted from the third light source 106 toward the light condensing unit 200, into parallel light.

The light condensing unit 200 collects the blue laser light B, the green laser light G, the red laser light R, and the excitation light O so as to generate white light W. The light condensing unit 200 has a first dichroic mirror 202, a second dichroic mirror 204, a third dichroic mirror 206, and a light integrator 208.

The first dichroic mirror 202 is a mirror that reflects at least the blue laser light B, and is arranged such it reflects the blue laser light B, which has passed through the first lens 112, toward the light integrator 208. The second dichroic mirror 204 is a mirror that reflects at least the mixed light GO and transmits the blue laser light B, and is arranged such it reflects the mixed light GO, which has passed through the second lens 114, toward the light integrator 208. The third dichroic mirror 206 is a mirror that reflects at least the red laser light R and transmits the blue laser light B and the mixed light GO, and is arranged such it reflects the red laser light R, which has passed through the third lens 116, toward the light integrator 208.

A mutual positional relation among the dichroic mirrors is determined such that the light paths of the laser lights reflected by the dichroic mirrors are parallel to each other and such that their respective laser lights are bundled and incident on the light integrator 208. In the present embodiment, the first dichroic mirror 202 to the third dichroic mirror 206 are arranged such that the areas where the laser lights or mixed light strike on the respective dichroic mirrors, namely the reflecting points of laser lights, are aligned on a same line.

The blue laser light B emitted from the first light source 102 is reflected by the first dichroic mirror 202 toward the second dichroic mirror 204. The mixed light GO emitted from the phosphor 130 is reflected by the second dichroic mirror 204 toward the third dichroic mirror 206, and is bundled with the blue laser light B, which has passed through the second dichroic mirror 204. The red laser light R emitted from the third light source 106 is reflected by the third dichroic mirror 206 toward the light integrator 208, and is bundled with the blue laser light B and the mixed light GO, which have passed through the third dichroic mirror 206. The blue laser light B, the green laser light G, the red laser light R, and the excitation light O bundled by the first dichroic mirror 202 to the third dichroic mirror 206 are incident on the light integrator 208.

The light integrator 208 is fitted to an opening 101 formed in a housing of the light source unit 100. The blue laser light B, the green laser light G, the red laser light R, and the excitation light O incident on the light integrator 208 are mixed by the light integrator 208 and turned into uniform light, thereby producing the white light W. The white light W travels from the light integrator 208 toward the scanning unit 300.

Scanning Unit

Figure 3:
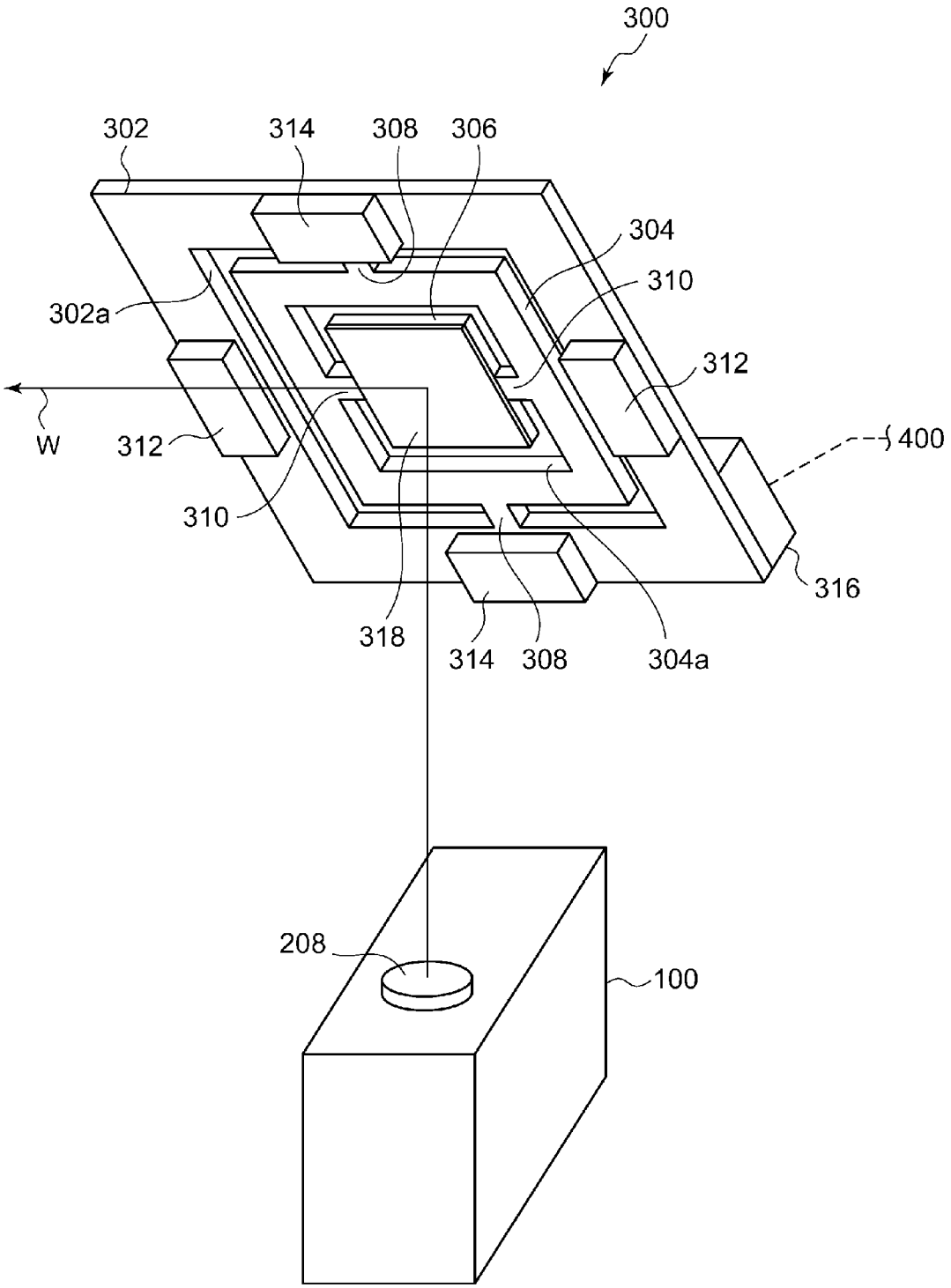
FIG. 3 is a schematic perspective view of a scanning unit as observed from a front side of the lamp.

FIG. 3 is a schematic perspective view of a scanning unit as observed from a front side of the lamp. The scanning unit 300 is a mechanism used to scan the white light W, emitted from the first light source unit 100 and form a predetermined light distribution pattern (see FIG. 4). The scanning unit 300 includes a base 302, a first rotating body 304, a second rotating body 306, first torsion bars 308, second torsion bars 310, permanent magnets 312 and 314, a terminal part 316, a reflector 318, and so forth. The base 302 is a frame body having an opening 302*a* in the center, and is secured to the tip of the protrusion 10 (see FIG. 1) such that the base 302 is tilted in the longitudinal directions of the lamp. The terminal part 316 is provided in a predetermined position of the base 302. The first rotating body 304 is arranged in the opening 302*a*. The first rotating body 304 is a frame body having an opening 304*a* in the center, and is turnably supported by the first torsion bars 308, which extend, from a rear lower side to a frontal upper side of the lamp, laterally (in the vehicle width direction) in relation to the base 302.

The second rotating body 306 is arranged in the opening 304*a* of the first rotating body 304. The second rotating body 306 is a rectangular plate, and is turnably supported by the second torsion bars 310, which extend, in the vehicle width direction, vertically in relation to the first rotating body 304. When the first rotating body 304 is turned laterally with the first torsion bars 308 as a turning shaft, the second rotating body 306 is turned laterally together with the first rotating body 304. The reflector 318 is provided on the surface of the second rotating body 306 by use of a plating, vapor deposition or like method.

A pair of permanent magnets 312 are provided on the base 302 in a position orthogonal to the direction along which the first torsion bars 308 extend. The permanent magnets 312 form a magnetic field running orthogonal to the first torsion bars 308. A first coil (not shown) is wired in the first rotating body 304, and the first coil is connected to the control unit 400 (see FIG. 1) via the terminal part 316. Also, a pair of permanent magnets 314 are provided on the base 302 in a position orthogonal to the direction along which the second torsion bars 310 extend. The permanent magnets 314 form a magnetic field running orthogonal to the second torsion bars 310. A second coil (not shown) is wired in the second rotating body 306, and the second coil is connected to the control unit 400 via the terminal part 316.

The first coil and the permanent magnets 312, and the second coil and the permanent magnets 314 constitute a scanning actuator. The drive of the scanning actuator is controlled by the control unit 400. The control unit 400 controls the amount and the direction of electric current flowing through the first coil and the second coil. Controlling the amount and the direction of electric current flowing therethrough enables the first rotating body 304 and the second rotating body 306 to turnably reciprocate from side to side (laterally) and enables the second rotating body 306 to turnably reciprocate vertically independently. As a result, the reflector 318 makes turnably reciprocating movements in vertical and lateral directions.

The white light W emitted from the light source unit 100 is reflected, by the reflector 318, in a frontward direction of the lamp. Then the scanning unit 300 scans a front area of the vehicle using the white light W by turnably reciprocating the reflector 318. For example, the scanning unit 300 turns the reflector 318 over a scanning range that is wider than a region where the light distribution pattern is formed. The control unit 400 turns on the first light source 102 to the third light source 106 when the turning position of the reflector 318 is in a position corresponding to the region where the light distribution pattern is formed. Thereby, the white light W is distributed over the region where the light distribution pattern is formed and, as a result, a predetermined light distribution pattern is formed in the front area of the vehicle.

Shape of Light Distribution Pattern

Figure 4:
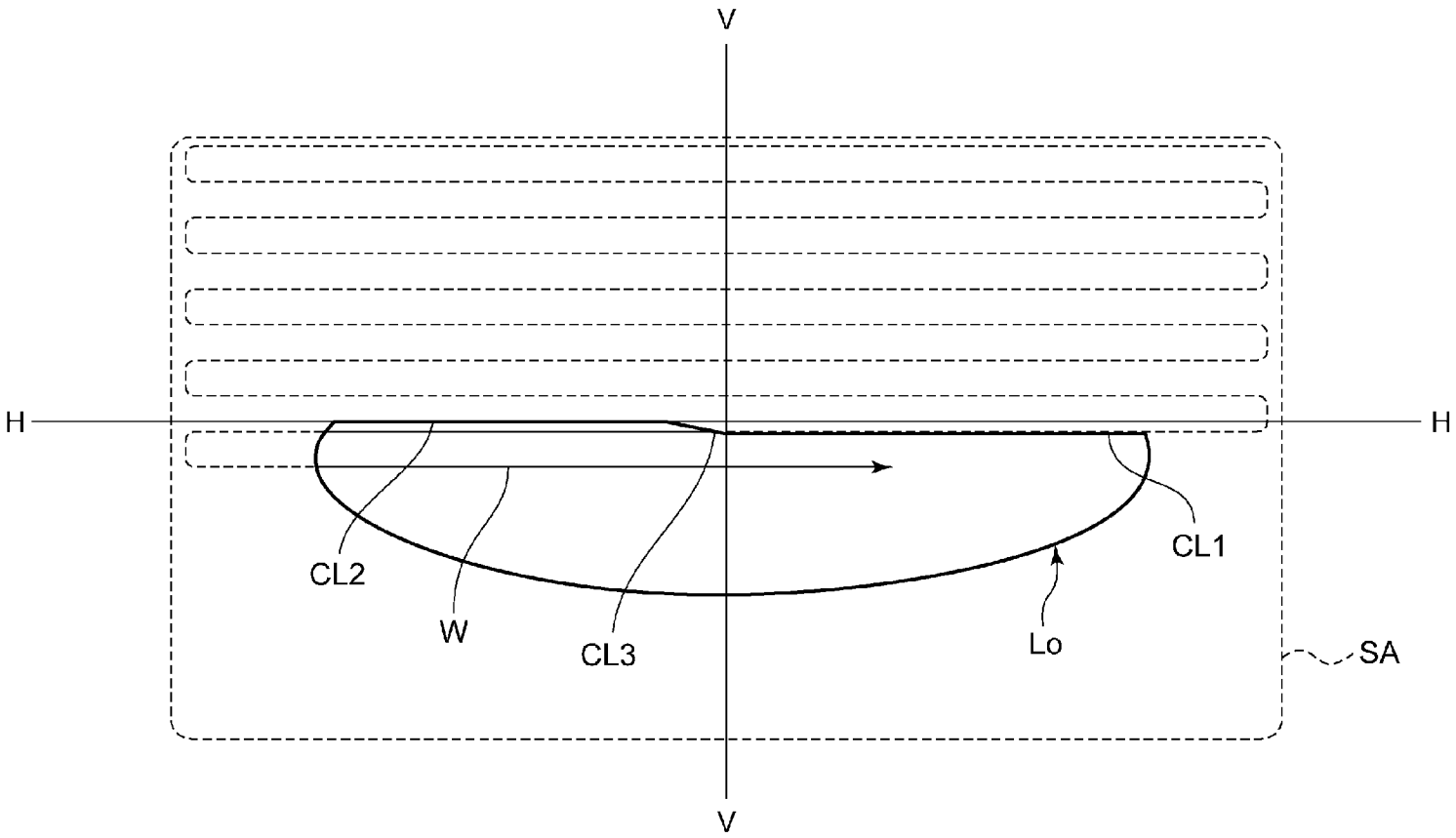
FIG. 4 shows an exemplary light distribution pattern formed by the automotive lamp according to the first embodiment.

FIG. 4 shows an exemplary light distribution pattern formed by the automotive lamp according to the first embodiment. FIG. 4 shows a visible light distribution pattern formed on a vertical virtual screen placed at a predetermined position in front of the lamp, for example, at a point 25 meters ahead of the lamp. The scan tracks of the white light W is shown schematically using broken lines and solid line.

The scanning unit 300 can scan a rectangular scan area SA, which extends in the vehicle width direction, with the white light W. When a scanning position of white light W by the scanning unit 300 is within a low beam distribution pattern Lo, the control unit 400 has each of the first light source 102 to the third light source 106 emit the laser light. When the scanning position thereof is outside the low beam distribution pattern Lo, the control unit 400 stops the emission of the laser light from each of the first light source 102 to the third light source 106. This forms the low beam distribution pattern Lo having a cutoff line CL1 on the side of an oncoming traffic lane, a cutoff line CL2 on the side of a driver's own lane and a sloping cutoff line CL3. The automotive lamp 1 can also form other light distribution patterns such as a high beam distribution pattern.

Color Rendering Properties of Automotive Lamp

Figure 5A:
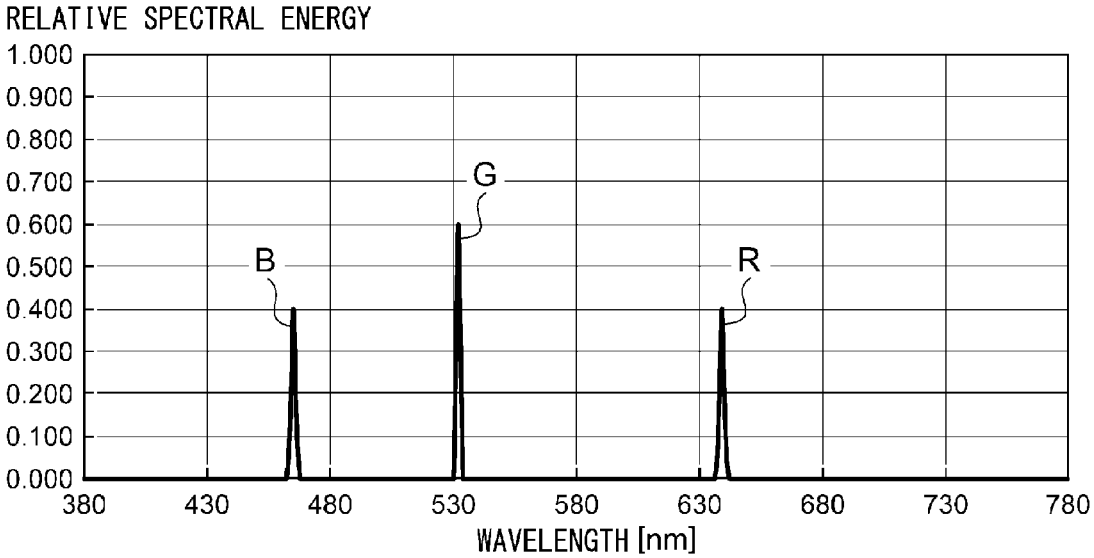
FIG. 5A is a graph showing the spectral distribution of the white laser light containing the blue laser light, the green laser light, and the red laser light.
Figure 5B:
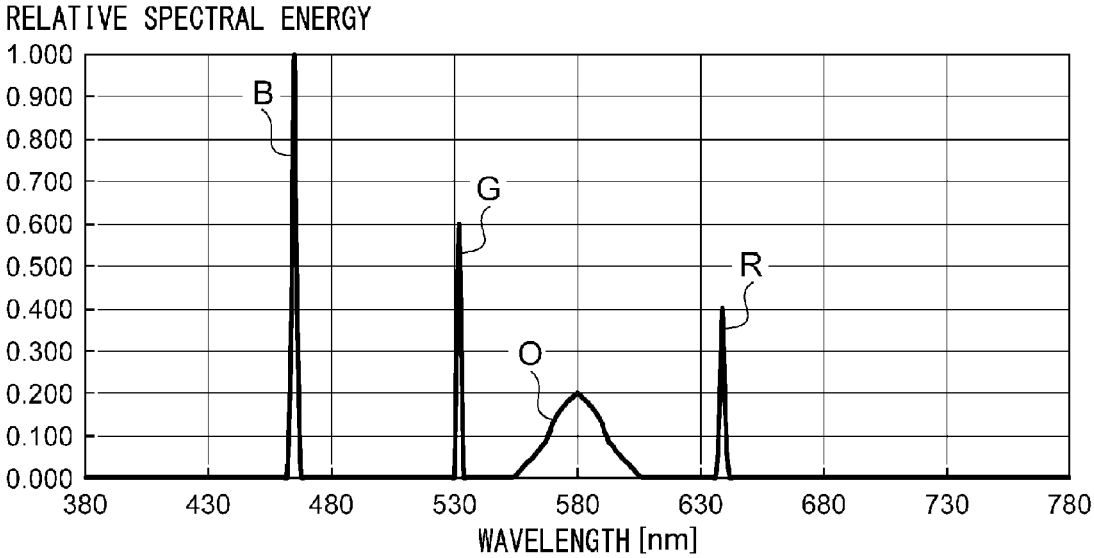
FIG. 5B is a graph showing the spectral distribution of the white light projected by the automotive lamp according to the first embodiment.

A detailed description is now given of the color rendering properties of the automotive lamp 1. FIG. 5A is a graph showing the spectral distribution of the white laser light formed by the blue laser light, the green laser light, and the red laser light. FIG. 5B is a graph showing the spectral distribution of the white light projected by the automotive lamp according to the first embodiment. FIGS. 5A and 5B are graphs where the horizontal axis indicates the wavelength (nm) and the vertical axis indicates the relative spectral energy. FIG. 5A shows, by way of an example, the spectral distribution of white laser light obtained by combining the blue laser light B having a peak wavelength 465 nm, the green laser light G having a peak wavelength 532 nm, and the red laser light R having a peak wavelength 639 nm. FIG. 5B shows, by way of an example, the spectral distribution of the white light obtained by combining the blue laser light B having a peak wavelength 465 nm, the green laser light G having a peak wavelength 532 nm, the excitation light O having a peak wavelength 580 nm, and the red laser light R having a peak wavelength 639 nm.

As shown in FIG. 5A, the white laser light obtained by combining the blue laser light B, the green laser light G, and the red laser light R has peak wavelengths, each having an extremely narrow bandwidth (half bandwidth), in a wavelength region of the blue light, in a wavelength region of the green light, and in a wavelength region of the red light, respectively. Generally, the chromaticity (x, y) and the color temperature (K) of the irradiation light of an automotive lamp are required to be adjusted to fit into a predetermined range for white color. An automotive lamp is also required to render umber and red faithfully in order to help distinguish between an umber colored object (e.g., a turn signal lamp of other vehicles or a delineator on the road shoulder) and a red colored object (e.g., a tail and stop lamp of other vehicles) clearly when they are irradiated. The white laser light having the aforementioned spectral distribution characteristics and adjusted so as to meet the condition defined for chromaticity and color temperature does not contain light distributed between the wavelength region of the green laser light G and the wavelength region of the red laser light R. As a result, an umber colored object may look red when irradiated, or the amount of light from the irradiated object may be so small that it may be difficult to view the irradiated object. This might result in difficulty to distinguish between a delineator etc. and a tail and stop lamp, etc. Another disadvantage is that a driver etc. whose vision is relatively less sensitive to red light might find it difficult to view the irradiated object.

By way of contrast, the automotive lamp 1 according to the present embodiment forms the white light W obtained by combining the blue laser light B, the green laser light G, the red laser light R, and the orange excitation light O. As shown in FIG. 5B, the white light W contains light (excitation light O) distributed between the wavelength region of the green laser light G and the wavelength region of the red laser light R. The excitation light O has a relatively large band width. Accordingly, the white light W has a spectral distribution between yellow and orange, unlike the white laser light mentioned above. For this reason, the white light according to the present embodiment is capable of rendering umber and red more faithfully than the white laser light so that an amber-colored object and a red colored object can be clearly distinguished from each other when they are irradiated. It is also possible to allow a driver etc. whose vision characteristic is as described above to view the irradiated object easily. Accordingly, the color rendering properties of the automotive lamp 1 equipped with a laser light source can be improved.

According to the present embodiment, the phosphor 130 is excited by the green laser light G. Alternatively, the phosphor 130 may be excited by the blue laser light B. The structure of such a phosphor is also publicly known so that a detailed description will be omitted. In this case, the phosphor 130 is provided on the light path of the blue laser light B and is excited by a portion of the blue laser light B emitted by the first light source 102.

As described above, the automotive lamp 1 according to the present embodiment collects the blue laser light B, the green laser light G, the excitation light O, and the red laser light R so as to generate white light W. This can improve the color rendering properties of the automotive lamp in comparison with the case where the blue laser light B, the green laser light G, and the red laser light R are collected so as to generate white laser light. As a result, the visibility for the driver can be improved. Further, the embodiment can simultaneously improve the color rendering properties of the automotive lamp and improve the light availability by using a laser light source. The first light source 102 or the second light source 104 is used to excite the phosphor 130. For this reason, the number of components in the automotive lamp 1 is prevented from growing as compared with a case where a light source for exciting the phosphor 130 is provided separately. The automotive lamp 1 forms a light distribution pattern using a combination of a laser light source and a scanning optical system. It is therefore possible to form a variety of light distribution patterns and prevent the light availability from dropping at the same time.

Second Embodiment

The structure of the automotive lamp according to the second embodiment is substantially identical to the structure of the automotive lamp according to the first embodiment except that the automotive lamp according to the second embodiment is provided with a phosphor configured to emit additional excitation lights P and Q in addition to the phosphor 130 configured to emit the excitation light O. The following description highlights the structure of the automotive lamp according to the second embodiment different from that of the first embodiment. Those components that are equivalent to the components of the first embodiment are denoted with the same reference numerals, and the description and illustration thereof are not repeated.

Figure 6:
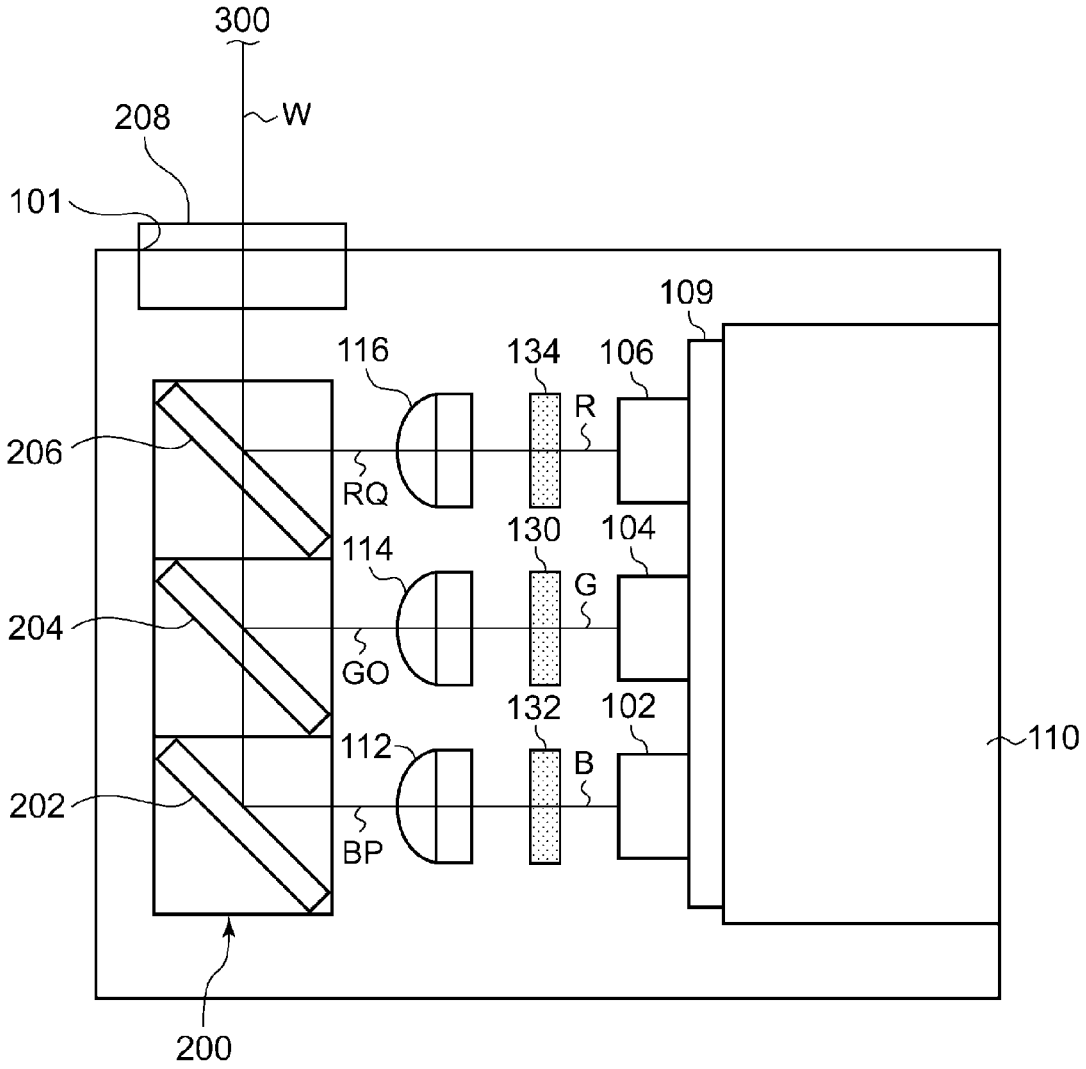
FIG. 6 is a side view schematically showing a structure of the light source unit of the automotive lamp according to the second embodiment.

FIG. 6 is a side view schematically showing a structure of the light source unit of the automotive lamp according to the second embodiment. FIG. 6 is a transparent view showing the interior of the light source unit 100. The light source unit 100 has a first light source 102, a second light source 104, a third light source 106, a heatsink 110, a first lens 112, a second lens 114, a third lens 116, a phosphor 130, a phosphor 132, a phosphor 134, and a light condensing unit 200, and other components.

The first light source 102 emits a blue laser light B having a peak wavelength in a wavelength region of 450 nm to 470 nm (both inclusive). The second light source 104 emits a green laser light G having a peak wavelength in a wavelength region of 510 nm to 550 nm (both inclusive). The third light source 106 emits a red laser light R having a peak wavelength in a wavelength region of 630 nm to 650 nm (both inclusive).

The phosphor 130 is excited by the green laser light G and emits excitation light O having a peak wavelength in a wavelength region of 580 nm to 600 nm (both inclusive). The phosphor 132 is excited by the blue laser light B and emits excitation light P having a peak wavelength in a wavelength region of 470 nm to 520 nm (both inclusive). The phosphor 134 is excited by the red laser light R and emits excitation light Q having a peak wavelength in a wavelength region of 650 nm to 700 nm (both inclusive).

The phosphor 132 converts the blue laser light B into a substantially blue-green light by wavelength conversion. The structure of the phosphor 132 is publicly known so that a detailed description will be omitted. In this embodiment, a portion of the blue laser light B emitted by the first light source 102 is used to excite the phosphor 132. The phosphor 132 is provided on the light path of the blue laser light B. The blue laser light B emitted from the first light source 102 is incident on the phosphor 132. A portion of the incident blue laser light B is converted by the phosphor 132 into the excitation light P by wavelength conversion and is emitted therefrom. The remaining portion of the blue laser light B is emitted from the phosphor 132 without being subjected to wavelength conversion. Therefore, a mixed light BP in which the blue laser light B and the excitation light P are mixed is emitted from the phosphor 132.

The phosphor 134 converts the red laser light R into a red light having a longer wavelength than the red laser light R by wavelength conversion. The structure of the phosphor 134 is publicly known so that a detailed description will be omitted. In this embodiment, a portion of the red laser light R emitted by the third light source 106 is used to excite the phosphor 134. The phosphor 134 is provided on the light path of the red laser light R. The red laser light R emitted from the third light source 106 is incident on the phosphor 134. A portion of the incident red laser light R is converted by the phosphor 134 into the excitation light Q by wavelength conversion and is emitted therefrom. The remaining portion of the red laser light R is emitted from the phosphor 134 without being subjected to wavelength conversion. Therefore, a mixed light RQ in which the red laser light R and the excitation light Q are mixed is emitted from the phosphor 134.

The light condensing unit 200 has a first dichroic mirror 202 to a third dichroic mirror 206, and a light integrator 208. The first dichroic mirror 202 reflects the mixed light BP, which has passed through the first lens 112, toward the light integrator 208. The second dichroic mirror 204 reflects the mixed light GO, which has passed through the second lens 114, toward the light integrator 208 and transmits the mixed light BP. The third dichroic mirror 206 reflects the mixed light RQ, which has passed through the third lens 116, toward the light integrator 208 and transmits the mixed light BP and the mixed light GO. The blue laser light B, the green laser light G, the red laser light R, the excitation light O, the excitation light P, and the excitation light Q bundled by the first dichroic mirror 202 to the third dichroic mirror 206 are incident on the light integrator 208. The blue laser light B, the green laser light G, the red laser light R, the excitation light O, the excitation light P, and the excitation light Q are mixed by the light integrator 208 and turned into uniform light, thereby producing the white light W. The white light W travels from the light integrator 208 toward the scanning unit 300.

Color Rendering Properties of Automotive Lamp

Figure 7:
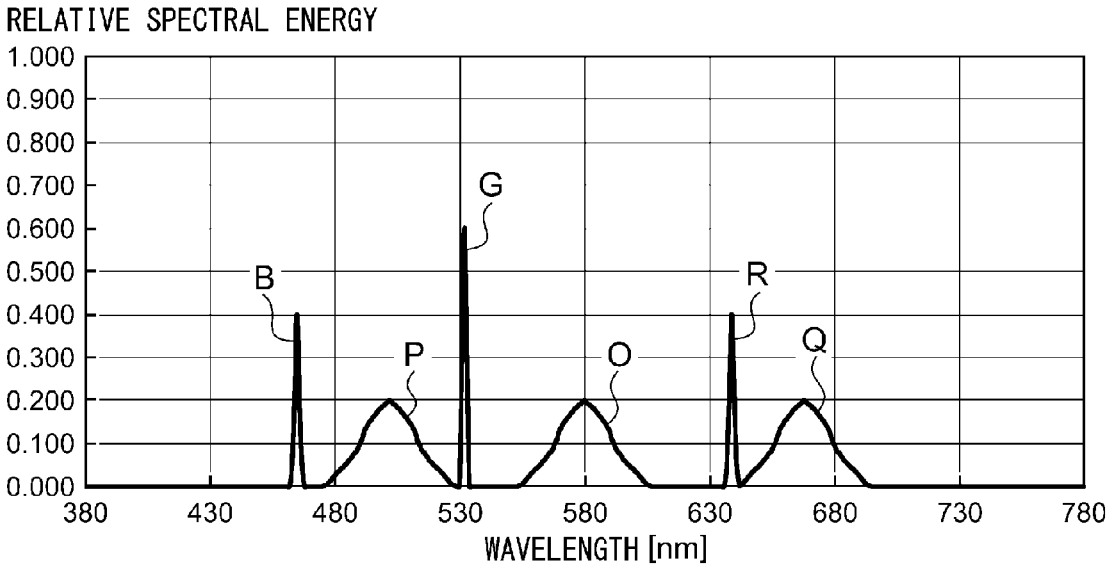
FIG. 7 is a graph showing the spectral distribution of the white light projected by the automotive lamp according to the second embodiment.

A description is now given of the color rendering properties of the automotive lamp 1. FIG. 7 is a graph showing the spectral distribution of the white light projected by the automotive lamp according to the second embodiment. FIG. 7 is a graph where the horizontal axis indicates the wavelength (nm) and the vertical axis indicates the relative spectral energy. FIG. 7 shows, by way of an example, the spectral distribution of white laser light obtained by combining the blue laser light B having a peak wavelength 465 nm, the excitation light P having a peak wavelength 502 nm, the green laser light G having a peak wavelength 532 nm, the excitation light O having a peak wavelength 580 nm, the red laser light R having a peak wavelength 639 nm, and the excitation light Q having a peak wavelength 668 nm.

The automotive lamp 1 according to the present embodiment forms the white light W obtained by combining the blue laser light B, the excitation light P, the green laser light G, the excitation light O, the red laser light R, and the excitation light Q. As shown in FIG. 7, the white light W contains light distributed between the wavelength region of the blue laser light B and the wavelength region of the green laser light G, light distributed between the wavelength region of the green laser light G and the wavelength region of the red laser light R, and light distributed in a region of longer wavelength than the wavelength region of the red laser light R. For this reason, the automotive lamp 1 according to the second embodiment is capable of generating the white light W having higher color rendering capability than the white light W generated by the automotive lamp 1 according to the first embodiment.

The phosphor 130 may be excited by the blue laser light B so as to emit the excitation light O. Both the phosphor 130 and the phosphor 132 may be provided on the light path of the blue laser light B. For the purpose of preventing the necessary intensity of the blue laser light B from becoming too high, however, it would be more favorable to excite the phosphor 130 by the green laser light G and excite the phosphor 132 by the blue laser light B as in the present embodiment. Only one of the phosphor 132 and the phosphor 134 may be additionally provided. The variation can also help improve the color rendering properties as compared with the first embodiment. When adding only one of the phosphor 132 and the phosphor 134, it would be favorable to add the phosphor 132 in terms of improvement in the color rendering properties.

The embodiments of the present invention are not limited to those described above and various modifications such as design changes may be made based on the knowledge of a skilled person, and such modifications are also within the scope of the present invention. A new embodiment modified as described above will provide the combined advantages of the embodiment and the variation as combined.

In the above-described embodiments, the scanning unit 300 can be configured by a galvanometer mirror, an MEMS mirror type, a polygon mirror type and so forth. Also, the automotive lamp 1 may be a projector-type lamp having a projection lens, for instance.

What is claimed is:

1. A vehicular lamp comprising:

a first laser light source emitting, along a first optical path, blue laser light having a peak wavelength in a wavelength region of from 450 nm to 470 nm;

a second laser light source emitting, along a second optical path, green laser light having a peak wavelength in a wavelength region of from 510 nm to 550 nm;

a third laser light source emitting, along a third optical path, red laser light having a peak wavelength in a wavelength region of from 630 nm to 650 nm;

a phosphor disposed in either the first or the second optical path, such that by being excited by either the blue laser light or the green laser light, the phosphor emits, along either the first or the second optical path, excitation light having a peak wavelength in a wavelength region of from 580 nm to 600 nm; and a light condensing unit for collecting, and emitting as generated white light, the blue laser light, the green laser light, the red laser light, and the excitation light.

2. The vehicular lamp according to claim 1, further comprising:

a phosphor that by being excited by the blue laser light emits excitation light having a peak wavelength in a wavelength region of from 470 nm to 520 nm.

3. The vehicular lamp according to claim 1, further comprising:

a phosphor that by being excited by the red laser light emits excitation light having a peak wavelength in a wavelength region of from 650 nm to 700 nm.

4. The vehicular lamp according to claim 1, wherein the light condensing unit includes a light integrator that mixes the blue laser light, the green laser light, the red laser light, and the excitation light to produce uniform white light.

* * * * *